US007658197B1

(12) United States Patent
Villagomez

(10) Patent No.: US 7,658,197 B1
(45) Date of Patent: Feb. 9, 2010

(54) SMOKING PIPE WITH CLEANING VALVE

(76) Inventor: Alvaro Villagomez, 6350 PGA Dr., North Fort Myers, FL (US) 33917

( * ) Notice: Subject to any disclaimer, the term of this patent is extended or adjusted under 35 U.S.C. 154(b) by 727 days.

(21) Appl. No.: 11/488,475

(22) Filed: Jul. 18, 2006

Related U.S. Application Data

(60) Provisional application No. 60/700,230, filed on Jul. 18, 2005.

(51) Int. Cl.
*A24F 1/02* (2006.01)

(52) U.S. Cl. ..... 131/245; 131/184.1; 131/184.2; 131/216; 131/223; 131/227; 131/228

(58) Field of Classification Search ..... 131/184.1, 131/184.2, 216, 223, 227, 228, 245
See application file for complete search history.

(56) References Cited

U.S. PATENT DOCUMENTS 1,200,271 A * 10/1916 Taylor ..... 131/184.2

* cited by examiner

*Primary Examiner*—Philip C Tucker
*Assistant Examiner*—Michael J Felton
(74) *Attorney, Agent, or Firm*—William E. Noonan

(57) ABSTRACT

A smoking pipe having a cleaning valve includes a pipe body with an internal bore. A combustion chamber is communicably connected with the bore. A cleaning valve is mounted adjustably within the bore. The valve includes a longitudinal channel and the valve is alternatable between a first position wherein the channel is communicably interconnects an orifice in the mouthpiece of the pipe and the combustion chamber and a second position wherein the channel is fully exposed so that it may be quickly and completely cleaned.

17 Claims, 7 Drawing Sheets

SMOKING PIPE WITH CLEANING VALVE

RELATED APPLICATION

This application claims the benefit of U.S. Provisional Patent Application Ser. No. 60/700,230 filed Jul. 18, 2005.

FIELD OF THE INVENTION

This invention relates to a smoking pipe equipped with a valve that permits the pipe to be cleaned quickly and completely each time the pipe is used.

BACKGROUND OF THE INVENTION

Smoking pipes have been available for thousands of years. Each time a pipe is used, residual tobacco and byproducts of the combusted tobacco collect in the tobacco chamber and air passageway of the pipe. Most smoking pipes must be periodically cleaned to remove this residue. Conventionally, such cleaning is performed using various types of devices such as pipe cleaners and brushes. The typical cleaning device is inserted through the passageway and manipulated to loosen debris within the pipe. This procedure can be tedious and time consuming. In most cases, residual tobacco and tobacco byproducts are not completely eliminated from the interior of the pipe. This can hinder efficient operation of the pipe and interfere with the smoker's subsequent smoking enjoyment. In addition, conventional brass pipes tend to conduct a considerable amount of heat and are very difficult for the user to directly handle without being burned.

SUMMARY OF THE INVENTION

It is therefore an object of the present invention to provide a smoking pipe that is quicker and easier to clean than conventional smoking pipes.

It is a further object of this invention to provide a smoking pipe that enables unburned pipe residue and tobacco byproducts to be cleaned completely and with minimal effort from the interior of the pipe.

It is a further object of this invention to provide a smoking pipe that may be used repeatedly and for virtually an indefinite duration without collecting smoking residue and byproducts that could otherwise damage the pipe and interfere with the smoking enjoyment.

It is a further object of this invention to provide a smoking pipe that may be cleaned without the need for tediously inserting and manipulating a pipe cleaner or brush through the interior of the pipe.

It is a further object of this invention to provide a smoking pipe having a cleaning valve that enables the pipe to be cleaned effectively and in a matter of seconds, and which permits the pipe to be conveniently cleaned each time it is used.

It is a further object of this invention to provide a smoking pipe that effectively dissipates heat and helps the smoker to avoid being burned while handling the pipe.

This invention results from a realization that a smoking pipe with significantly improved cleaning capability is achieved by using an adjustable interior cleaning valve within the body of the pipe and by further providing that valve with a cleaning channel that remains in communication with the combustion chamber and air passageway of the pipe while the pipe is in use. The valve is manipulated after each use of the pipe so that the channel is exposed for quick and convenient cleaning of residue and byproduct that has collected in the channel while the pipe was smoked.

This invention features a smoking pipe including a pipe body having an orifice for engaging the smoker's mouth and an internal bore that communicates with the orifice. The pipe body carries a bowl portion having a combustion chamber that communicates with the internal bore of the pipe body. The combustion chamber is for receiving tobacco. A cleaning valve is mounted adjustably in the bore of the pipe body. The valve has a longitudinal channel. The cleaning valve is alternated between first and second positions. In the first position, the channel extends communicably between the combustion chamber and the orifice to define an air passageway through the pipe body for transmitting air and smoke from the chamber to the orifice when smoking tobacco is being burned in the combustion chamber. In the second position, the channel is uncovered and exposed by the body and accessible for cleaning.

In a preferred embodiment, the cleaning valve includes an elongate shank that is axially rotatably mounted in an elongate bore formed in the pipe body. The body may include an elongate cleaning slot that is aligned with the channel when the cleaning valve is in the second position such that the channel is exposed through the elongate slot. The pipe body may include a distal wall at an end of the pipe body opposite the orifice. The shank may be interconnected by means of a shaft or spindle that passes through an opening in the outer wall of the body to a shank actuator. The shank actuator may include a disk-shaped element that is flushly interengagable with an exterior surface of the end wall of the pipe body. A first magnetic component may be carried by one of the inner surface of the disk-shaped actuator and the outer surface of the pipe's end wall. A second magnetic component is carried by the other of the actuator and the end wall. The actuator is selectively rotated to position the shank in the first or second shank position as needed. With the cleaning valve in the first position, the actuator is positioned over the end wall of the pipe body such that the magnetic components magnetically interengage. The magnetic components thereby hold the disk-shaped shank actuator in retaining interengagement with the outer wall of the pipe body so that the cleaning valve is held in a closed condition.

Alternatively, the user may grasp the disk-shaped actuator and rotate the entire cleaning valve. Performing such rotation causes the magnetic components to disengage one another. The actuator is rotated until the shank is aligned with the elongate slot in the pipe body. This uncovers the channel in the cleaning valve and exposes the channel so that it may be quickly and completely cleaned by a cotton swab or other means.

The pipe body may have a tapered proximal end disposed about the orifice for defining at least a portion of a mouthpiece of the pipe. The shank may include a tapered proximal end that interengages the tapered proximal end of the pipe body to form a complete mouthpiece for the pipe. In the first cleaning valve position, the mouthpiece of the pipe encloses a proximal end of the channel. The proximal end of the channel only is exposed exteriorly of the pipe body through the orifice.

A distal end of the shank includes a shoulder that interengages an interior surface of the end wall of the pipe body. The shaft extends through an opening formed in the end wall and interconnects the distal end of the shank to the actuator disk.

The cleaning valve may be rotated from the first position to the second position by peripherally grasping the actuator disk and disengaging the complementary magnetic components. There is sufficient play between the shoulder of the shank and the inside surface of the end wall, as well as between the inner surface of the actuator disk and the outer surface of the end wall to permit the actuator disk to pull slightly apart from the end wall of the pipe body. In doing so, the attractive force between the complementary magnetic components is broken. When this separation is made, the actuator disk is rotated such that the connecting shaft rotates through the end opening in the wall. This in turn axially rotates the shank until the longitudinal channel in the shank is aligned with and exposed through the elongate slot in the pipe body. Once again, the longitudinal channel is exposed so that it is readily accessible for cleaning by a cotton swab or similar product. The interengagement between the shoulder of the shank and the inner surface of the pipe body's end wall holds the shank securely within the pipe body and prevents it from being removed as the cleaning valve is adjusted between the first and second positions. The connecting shaft of the cleaning valve may be attached by a hex screw to the actuator disk.

The combustion chamber may include a discharge outlet that communicates with the internal bore of the pipe body. When the cleaning valve is in the first position, the channel communicates with the discharge outlet so that smoking tobacco burned in the combustion chamber drops in or migrates into the channel, which extends between the combustion chamber and the orifice.

The pipe body may include a relatively narrow stem portion and a relatively wide stummel portion. The stem portion and the stummel portion may be unitarily interconnected. Typically, the combustion chamber is carried by the stummel portion. The stem portion may include the orifice, as well as the tapered portion forming at least a part of the mouthpiece of the pipe.

In an alternative embodiment, the cleaning valve may be fully removable from the bore of the pipe body. In such versions, the cleaning valve may fit through an opening formed at a distal end of the pipe body. The cleaning valve in this version may again include an elongate shank having a longitudinal channel that, in a first position, communicably interconnects the combustion chamber with the orifice. The cleaning valve may also include a mounting member that covers the distal opening in the pipe body. The pipe body and the mounting member may include complementary magnetic elements that are selectively interengaged to hold the mounting member against the distal end of the pipe body. In this condition, the channel of the cleaning valve remains in communication between the combustion chamber and the orifice of the pipe body. In a second condition, the mounting member is disengaged from the distal end of the pipe body by disengaging the complementary magnet components. The mounting member is then pulled apart from the pipe body such that the shank is withdrawn from the bore of the pipe body. This fully exposes the longitudinal channel so that it may be cleaned in the previously described manner.

DETAILED DESCRIPTION OF PREFERRED EMBODIMENTS

Other objects, features and advantages will occur from the following description of a preferred embodiment and the accompanying drawings, in which.

Figure 1:
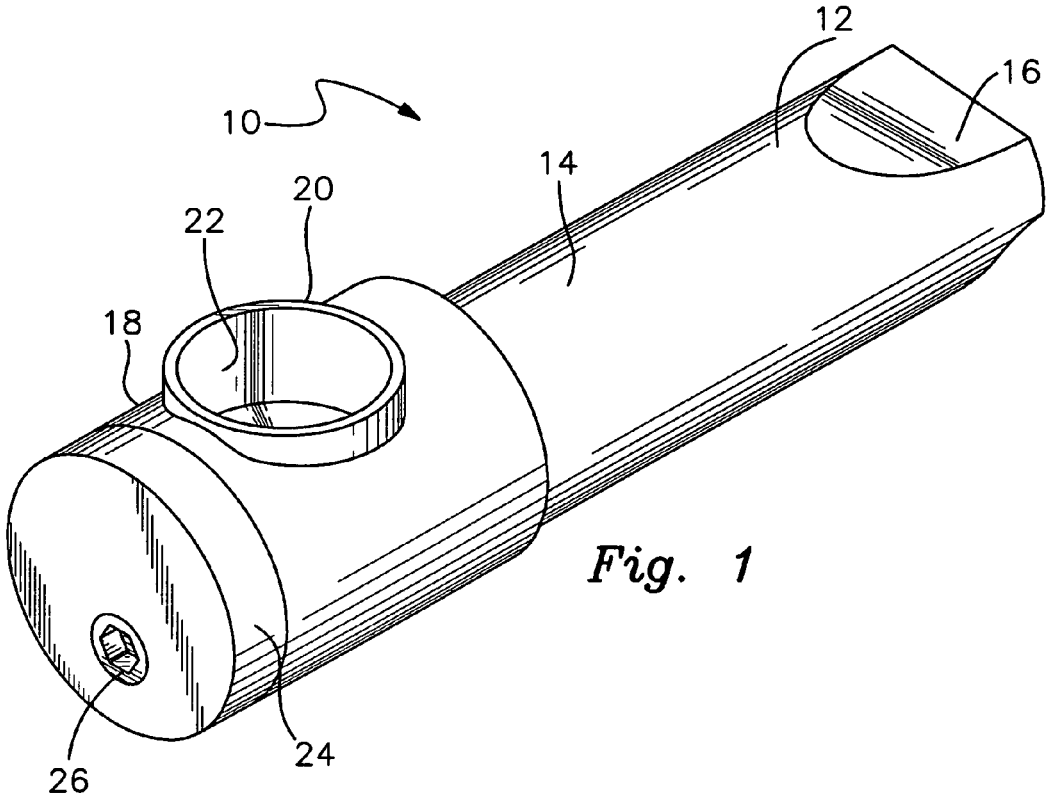
FIG. 1 is a perspective view of a smoking pipe according to this invention.
Figure 2:
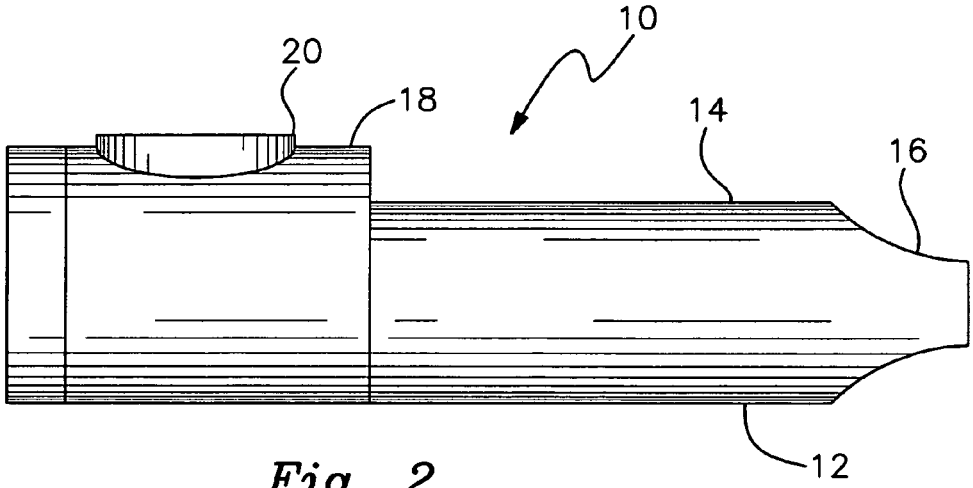
FIG. 2 is a side elevational view of the pipe of FIG. 1.
Figure 3:
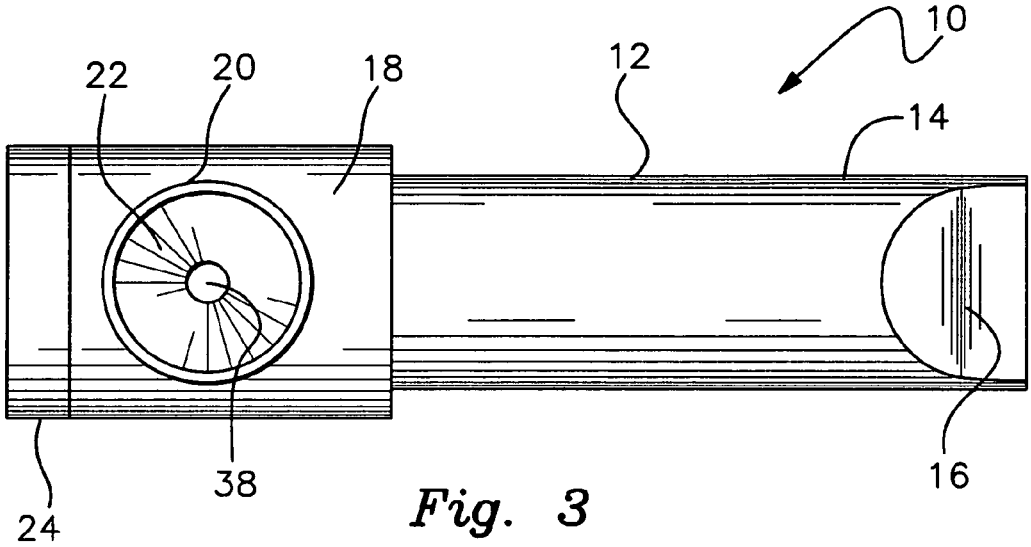
FIG. 3 is a top plan view of the pipe.
Figure 4:
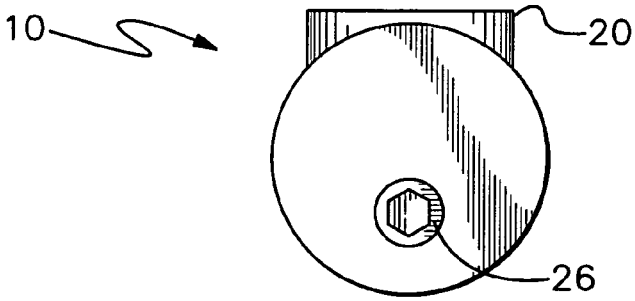
FIG. 4 is an elevational distal end view of the pipe.

There is shown in FIGS. 1-4 a smoking pipe 10. The pipe includes a one-piece pipe body 12 preferably composed of aluminum or similar material. Alternative materials may be employed, although aluminum is preferred because it effectively dissipates heat produced during use of the pipe. Body 12 includes a relatively narrow diameter stem portion 14 having a tapered mouthpiece 16 formed at a first proximal end thereof. A relatively large diameter stummel portion 18 is unitarily interconnected to stem portion 14. A bowl 20 having an internal combustion chamber 22 is formed in stummel portion 18. The combustion chamber is constructed in a manner that is described in greater detail below. Typically, the combustion chamber is composed of extremely durable and heat resistant material such as stainless steel.

The distal end of stummel portion 18 carries and is flushly interengaged by a disk-shaped actuator member 24 of an internal cleaning valve, which is described more fully below. Actuator member 24 is secured to the internal components of the cleaning valve by attachment means such as a hex screw 26.

Figure 5:
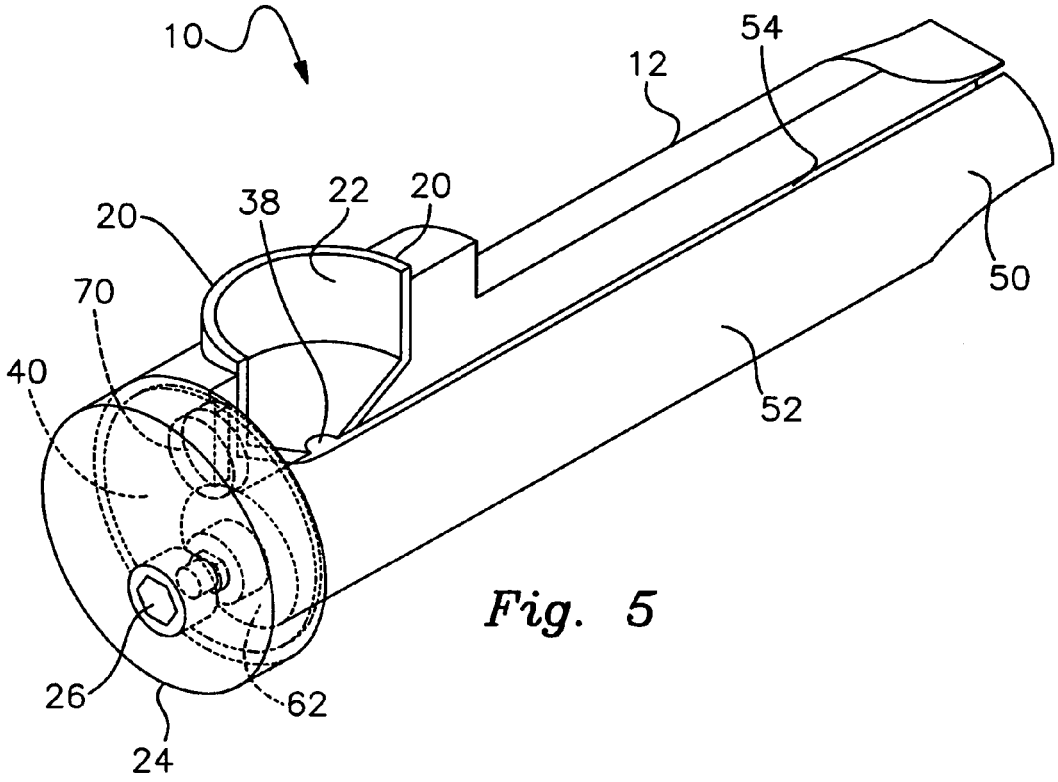
FIG. 5 is a perspective and partly cutaway view of the pipe of FIGS. 1-4 with the internal components of the pipe body and cleaning valve particularly depicted.
Figure 6:
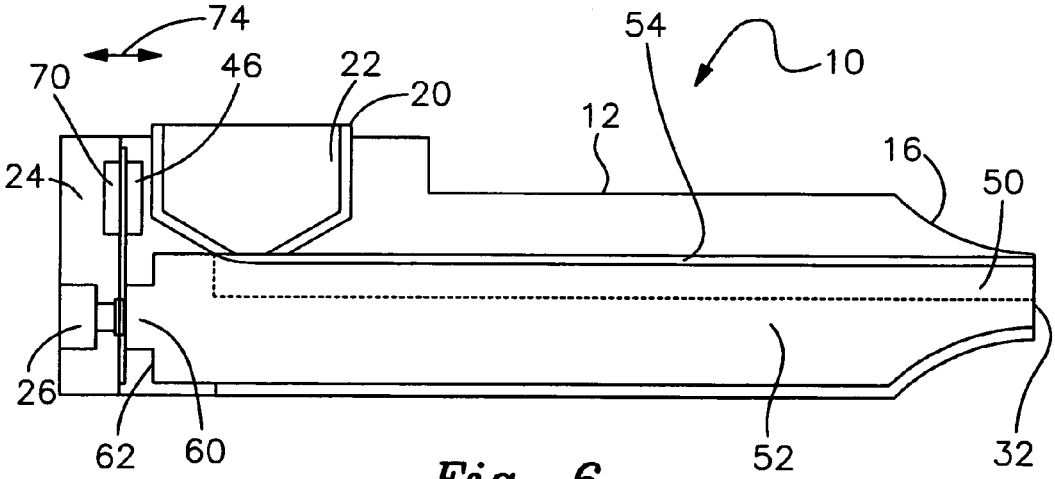
FIG. 6 is an elevational side view similar to that of FIG. 5.
Figure 12:
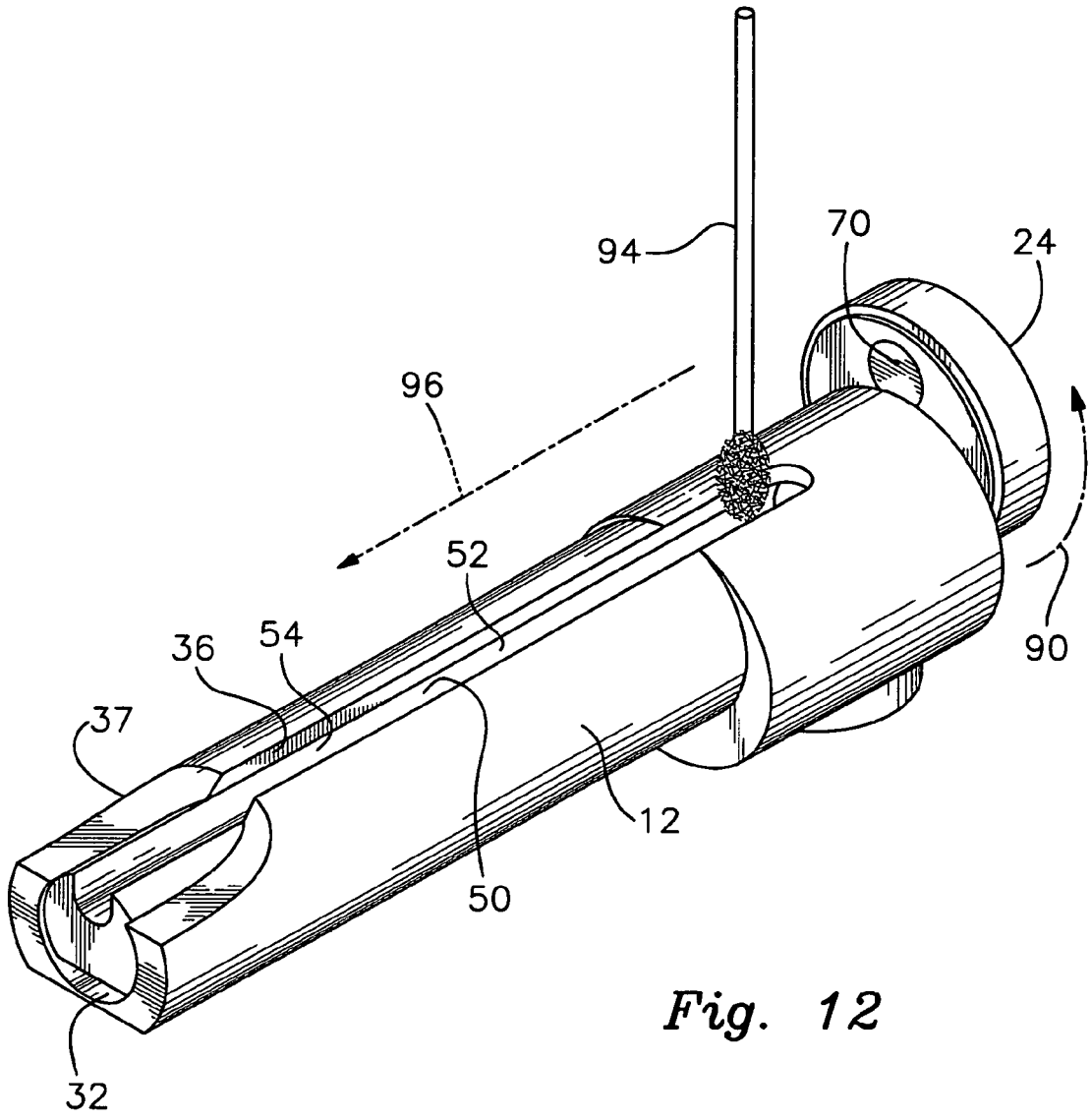
FIG. 12 is a perspective view of the pipe with the cleaning valve in its second position wherein the cleaning valve channel is exposed for cleaning by a cotton swab.

The internal construction of pipe 10 is shown more clearly in FIGS. 5 and 6. Pipe body 12, which is depicted in alone in cross-section in FIGS. 7 and 8, includes an interior bore 30 that extends centrally through the pipe body between an orifice 32 at the first end to a reduced diameter opening 34 at an opposite second end. A longitudinal slot 36 extends between mouthpiece section 16 and a forward end of the pipe body. Slot 36 is in communication with central bore 30 and extends along the bottom of the pipe body. At the proximal end of the pipe body, i.e. at mouthpiece portion 16, slot 36 laterally widens as the body forms its tapered mouthpiece 16. This widened slot 37 in the pipe body is best shown in FIG. 12. Bowl 20 includes a lower discharge outlet 38 that communicably interconnects combustion chamber 22 with internal bore 30.

Figure 7:
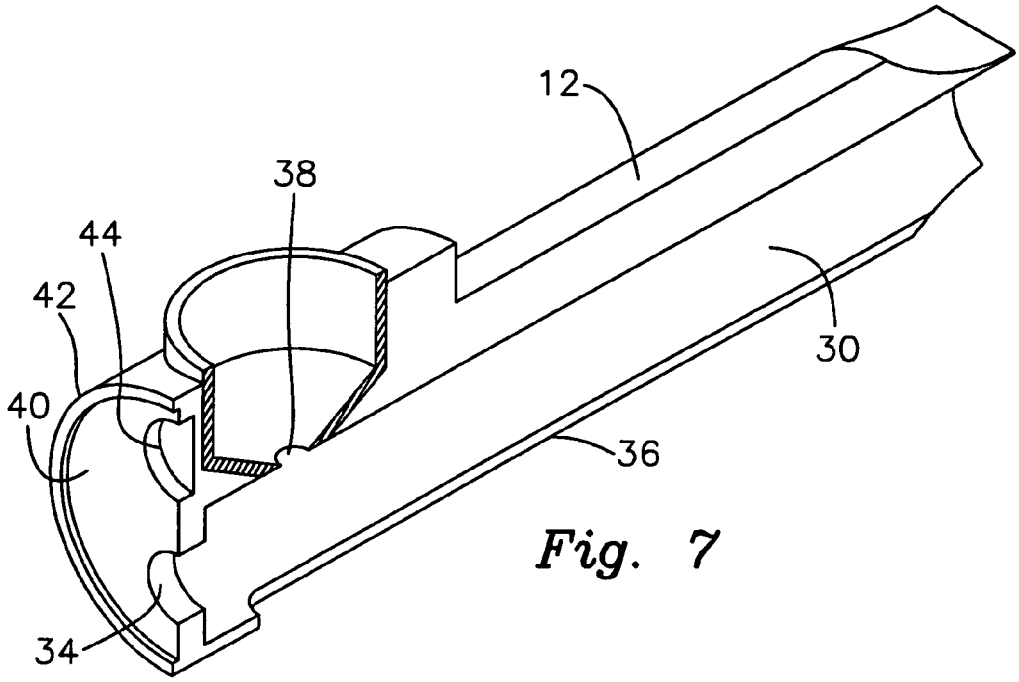
FIG. 7 is a perspective cross sectional view of the pipe body.
Figure 8:
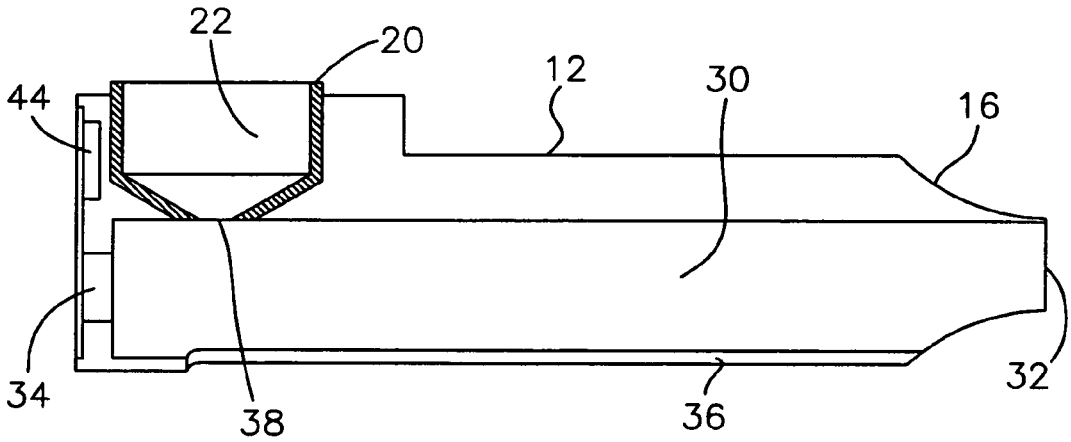
FIG. 8 is an elevational side view of the pipe body.

Pipe body 12 further includes a forward or distal end wall 40, best shown in FIGS. 5 and 7, which is surrounded by a peripheral lip 42 of body 12. Wall 40 may be formed unitarily with or separately and distinctly from the remainder of body 12. Reduced diameter opening 34, FIGS. 7 and 8, is formed through wall 40 and in communication with the remainder of bore 30. A disk-shaped recess 44 is formed in wall 40 for accommodating a magnetic component 46, FIG. 6. The function of this component is described more fully below.

Figure 9:
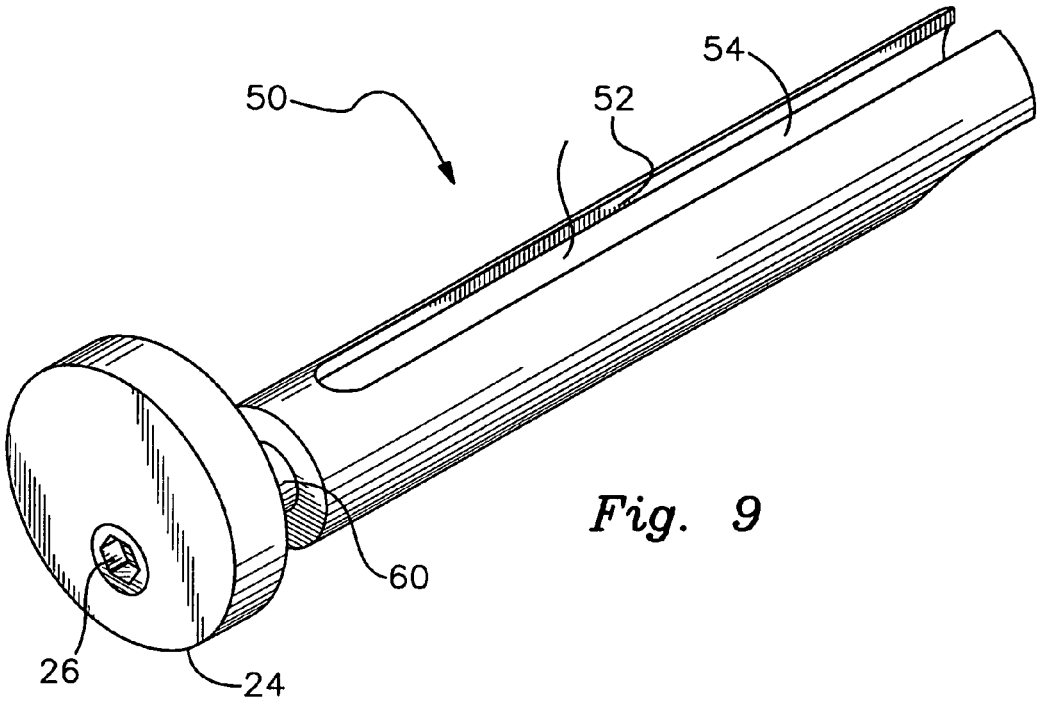
FIG. 9 is a perspective view of the cleaning valve employed in the preferred version of the pipe.
Figure 10:
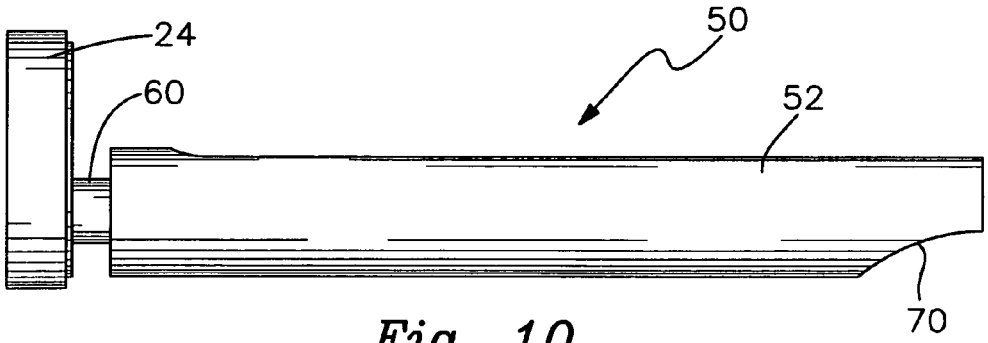
FIG. 10 is an elevational side view of the cleaning valve.
Figure 11:
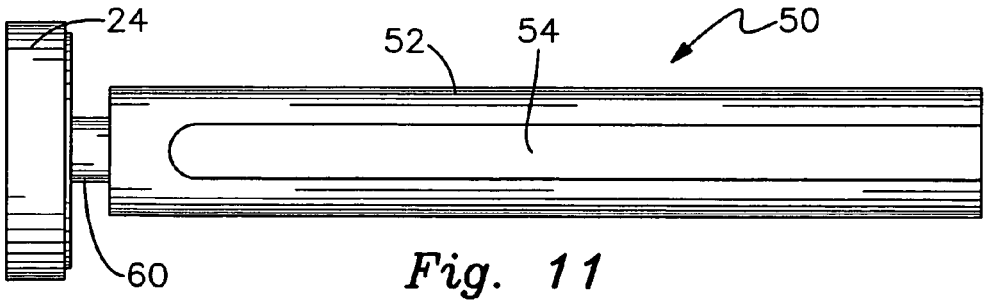
FIG. 11 is a top plan view of the cleaning vale.

As shown in FIGS. 5 and 6, an axially rotatable cleaning valve 50 is operably mounted within bore 30 of pipe body 12. Cleaning valve 50, which is shown alone in FIGS. 9-11, is typically composed of stainless steel or other durable metal or metal alloy material. The cleaning valve comprises an elongate, axially rotatable shank 52 having a longitudinal channel 54 formed therein. See FIGS. 5, 9 and 11. Channel 54 has a depth that extends to slightly less than half the diameter of shank 52. The channel extends for a length that is approximately equivalent to that of slot 36 formed in the bottom of pipe body 12.

A shaft 60 is unitarily connected to shank 52 and accommodated within reduced diameter section 34 of bore 30. As a result, as best shown in FIGS. 5 and 6, shank 52 includes a forward shoulder 62 that interengages that portion of pipe body 12 surrounding opening 34. This retains the cleaning valve within the bore of the pipe body and prevents it from being pulled out of the forward end of the pipe body. As described more fully below, in alternative embodiments, the cleaning valve may be removable from the pipe body for cleaning.

Cleaning valve 50 includes a tapered portion 70, best shown in FIG. 10, proximate mouthpiece portion 16 of pipe body 12. This tapered portion 70 is exposed through the widened slot portion 37 (FIG. 12) of pipe body 12 so that when the pipe is in use, tapered portion 70 and generally conforming widened slot portion 37 define the bottom of mouthpiece 16.

As previously stated, actuator member 24 is carried at the leading distal end of cleaning valve 50. More particularly, as shown in FIGS. 9-11, actuator member 24 is fastened to a leading end of shaft 60. The actuator member preferably has a disk or similar shape and is composed of stainless steel or other material similar to that composing the remainder of the cleaning valve. A hex screw 26 fastens the actuator member to shaft 60. Shaft 60 is attached axially rotatably to actuator member 24 and unitarily to shank 52. This allows cleaning valve to be properly positioned within the bore of the pipe body so that the cleaning valve may be alternated between a first position wherein the pipe is employed for smoking and a second position wherein the valve is orientated so that the pipe may be cleaned. These respective positions are described more fully below. Disk-shaped actuator member 24 flushly interengages the leading end of the pipe body. When the actuator member is rotated about hex screw 26, the entire cleaning valve rotates axially within the bore of the pipe body. This allows the cleaning valve to be alternated between the two positions. During rotation of the actuator member, the inwardly facing surface of that disk-shaped member sweeps across the outer wall of the pipe body in a generally flush manner.

As best shown in FIGS. 5 and 6, the inner surface disk-shaped actuator 24, which faces the outer end of the pipe body includes a pocket that receives a second magnetic component 70. This component is complementary with component 46 carried by the outer wall of the pipe body. Complementary magnetic components 46 and 70 are magnetically attracted to one another such that they interengage to hold actuator member 24 in a locked position against outer wall 40 of pipe body 12. Various types of permanent magnets and magnetically attracted components, which will be known to persons skilled in the arts, may be employed. The magnetic attraction between the components should be sufficient to hold the actuator member securely in place against the forward end wall of the pipe body. Unintended rotation of the valve is resisted. However, the magnetic force should be weak enough to allow the user to manually disengage the magnetic components and rotate the actuator member and valve when the user desires to clean the pipe. Various numbers, configurations and arrangements of magnets and magnetically attractive components may be utilized.

Preferably, there is a slight amount of play or tolerance between the leading shoulder 62 of shank 52 and the corresponding, inwardly turned shoulders of the pipe body. This allows actuator 24 to move slightly back and forth relative to the pipe body as indicated by doubleheaded arrow 74 in FIG. 6. To magnetically disengage component 70 from component 46, the user pulls member 24 forwardly. The slight tolerance or play between the leading shoulder of the shank and the corresponding shoulder of the pipe body allows the entire cleaning valve 50 to move forward slightly so that components 46 and 70 are magnetically disengaged. The user can then rotate actuator member 24 about screw 26 to reposition the cleaning valve so that cleaning may be performed.

Cleaning valve 50 particularly may be alternated between a first position as shown in FIGS. 5 and 6 and a second position as shown in FIG. 12. The positioning shown in FIGS. 5 and 6 is the state the cleaning valve maintains while pipe 10 is being used for smoking. Actuator member 24 is rotated so that magnetic components 46 and 70 are aligned. Member 24 is then released and the magnetic components magnetically adhere to one another to hold the actuator member in place in the manner shown in FIGS. 5 and 6. As best depicted in FIG. 5, channel 54 is now in communication with discharge outlet of combustion chamber 22. By the same token, the opposite end of channel 54 communicates with orifice 32 (FIG. 8) in pipe body 12.

Pipe 12 is smoked with the cleaning valve in the position shown in FIGS. 5 and 6. In particular, tobacco is deposited into combustion chamber 22 of bowl 20. The user then lights the tobacco and smoke is delivered through the passageway formed by channel 38 to orifice 32 of mouthpiece 16. The user inhales the smoke from the pipe in a well known manner.

During the smoking process, tobacco residue and other smoking byproducts are deposited along the length of channel 54. It is usually desirable to clean such debris from the pipe each and every time the pipe is used. This maintains the pipe in better condition and improves the quality of the smoking experience. The smoker is able to clean pipe 10 quickly and completely following each use. When smoking is completed, the user first taps, scrapes or brushes any remaining smoking material from combustion chamber 22. The user then inverts pipe 12 so that the longitudinal slot 36 in pipe body 12 faces upwardly, as shown in FIG. 12. The user peripherally grasps actuator member 24 and pulls the actuator member forwardly so that magnetic components 46 and 70 (FIG. 6) disengage. This effectively unlocks the actuator member from the pipe body. The user rotates the actuator member as indicated by arrow 9 in FIG. 12 until the longitudinal channel 54 in shank 52 of cleaning valve 50 is aligned with slot 36 in pipe body 12. This fully exposes the longitudinal channel in valve 50 so that it may be cleaned quickly and completely. This is accomplished by inserting a cotton swab 94 through slot 36 and into the exposed channel 54 where residue and debris have collected. The user simply sweeps swab 94 in the direction of arrow 96 to clean the residue from the channel and out through the open mouthpiece end of the pipe. The exposed channel may be swept as many times as required to completely clean the channel and air passageway of tobacco residue. When cleaning is complete, the user simply rotates actuator member 24 back to into alignment with the distal end of the pipe body. The actuator member is released and the aligned magnets re-engage the actuator member and the pipe body so that the actuator member is held in place with the cleaning valve locked in the first position and ready to be used again for smoking.

Figure 13:
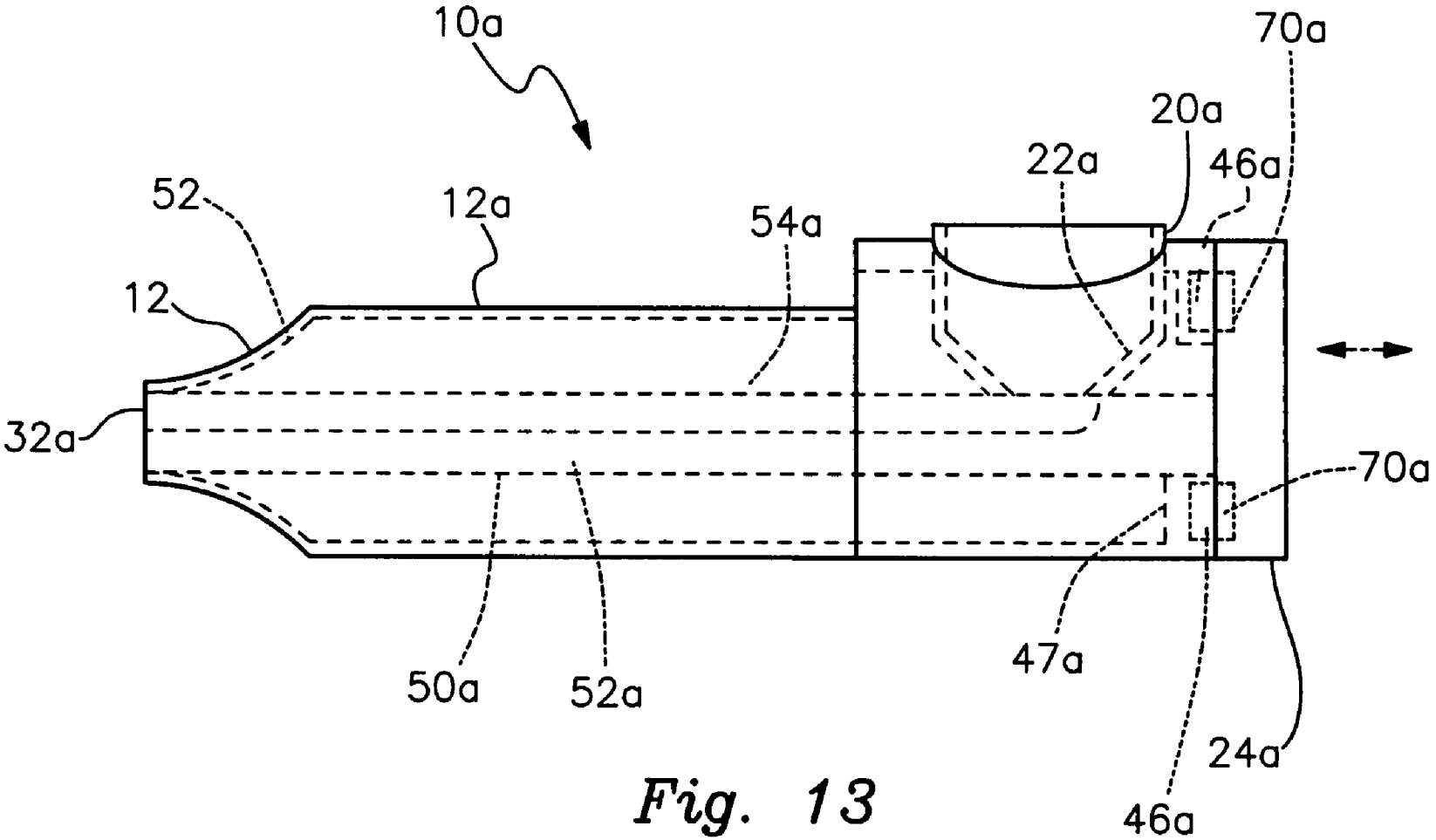
FIG. 13 is an elevational side view of an alternative smoking pipe according to this invention wherein the cleaning valve is fully withdrawn from the pipe body to perform cleaning.

In the alternative embodiment shown in FIG. 13, pipe 10*a* again includes an outer pipe body 12*a* and an inner cleaning valve 50*a*. A bowl 20*a* having a combustion chamber 22*a* is mounted the pipe body in the manner to that previously described. Cleaning valve 50*a* includes an elongate shank 52*a* having a longitudinal channel 54*a* formed therein. A distal end of shank 52*a* is secured to a disk-shaped mounting member 24*a*. Mounting member 24*a* carries on its inner surface one or more magnetic components 70*a* that interengage complementary magnetic components 46*a* carried by an inwardly turned lip 47*a* of pipe body 12*a*. This secures the mounting member and the entire cleaning valve within a central bore of pipe body 12*a*. Unlike the prior embodiment, the forward end of the pipe body is largely open so that the cleaning valve may be removed from or inserted into the pipe body as required through the open forward end of the pipe body.

In this version, the cleaning valve is not rotated within the pipe body between the first and second positions; rather, it is alternately inserted into the pipe body for use during smoking and removed from the pipe body for cleaning. Cleaning valve 50*a* is disposed in the first position suitable for smoking in FIG. 1. Therein, the cleaning valve is fully inserted within the pipe body. Mounting member 24*a* is engaged with the leading end of the pipe body such that magnets 46*a* and 70*a* magnetically adhere to one another to hold the cleaning valve in place. In this condition, longitudinal channel 54*a* extends communicably between a discharge outlet of combustion chamber 22*a* and orifice 32*a* at the mouthpiece end of the pipe body. Tobacco is introduced into the combustion chamber and smoked such that smoke and air pass through the passageway defined by channel 54*a*.

When smoking is completed, the user cleans pipe 12*a* by simply peripherally grasping actuator member 24*a* and pulling the actuator member away from the forward end of the pipe. Magnetic components 46*a* and 70*a* disengage and the entire cleaning valve is pulled forwardly and withdrawn from the pipe body. Channel 54*a* is thereby fully exposed so that it can be cleaned by a cotton swab or otherwise in a manner similar to that previously described. When cleaning is completed, the shank of the cleaning valve is inserted back into the forward end of the pipe body and the actuator member is magnetically reengaged with the leading end of the pipe body. The pipe is then ready for re-use.

The smoking pipe of this invention permits the pipe to be cleaned quickly and completely. No longer does the user have to manipulate brushes, pipe cleaners, etc. Cleaning may be performed in 15 seconds or less. The pipe is maintained in a clean condition so that it exhibits a much longer life and performs much more effectively. An improved smoking experience is thereby achieved.

The dual metal composition is particularly effective for avoiding burns to the users. The internal stainless steel construction of the combustion chamber and cleaning valve is extremely durable and heat resistant. The use of aluminum by the pipe body helps to effectively dissipate the heat generated by the pipe. The user may grasp the aluminum pipe safely and without risking a serious burn.

From the foregoing it may be seen that the apparatus of this invention provides for a valve that permits the pipe to be cleaned quickly and completely each time the pipe is used. While this detailed description has set forth particularly preferred embodiments of the apparatus of this invention, numerous modifications and variations of the structure of this invention, all within the scope of the invention, will readily occur to those skilled in the art. Accordingly, it is understood that this description is illustrative only of the principles of the invention and is not limitative thereof.

Although specific features of the invention are shown in some of the drawings and not others, this is for convenience only, as each feature may be combined with any and all of the other features in accordance with this invention.

Other embodiments will occur to those skilled in the art and are within the following claims:

What is claimed is:

1. A smoking pipe comprising:

a pipe body having an orifice for engaging a smoker's mouth and an internal bore that communicates with said orifice; said pipe body carrying a bowl portion that has a combustion chamber for accommodating tobacco to be smoked, which bowl portion communicates with said internal bore of said pipe body; and an elongate cleaning valve mounted adjustably in said bore; said valve having a longitudinal channel and being alternatable between a first, closed position wherein said channel extends communicably between said combustion chamber and said orifice to define a passageway through said pipe body for transmitting smoke from said combustion chamber and through said orifice to the smoker when tobacco is being burned in said combustion chamber and a second, open position wherein said channel is uncovered and exposed by said body to be accessible for cleaning wherein the said valve includes an elongate shank that is axially rotatably mounted in an elongated bore formed in said pipe body.

2. The pipe of claim 1 in which said body includes an elongate cleaning slot that is aligned with said channel when said cleaning valve is in said second position such that said channel is exposed through said slot.

3. The pipe of claim 2 further including a valve actuator that is attached to said shank exteriorly of said pipe body, said actuator being rotatable to selectively alternate said valve between said closed and open positions.

4. The pipe of claim 3 in which said body includes a distal wall at an end of said body opposite said orifice, said shank being interconnected to said valve actuator by a shaft that extends through an opening in said distal wall.

5. The pipe of claim 4 in which said actuator is flushly interengagable with an exterior surface of said distal wall.

6. The pipe of claim 4 further including a first magnetic component carried by one of said actuator and said distal wall and a second magnetic component carried by the other of said actuator and said distal wall, said actuator being rotated to position said shank selectively in one of said first and second positions, said first and second magnetic components being magnetically interengaged when said shank is in the first position to hold said actuator in retaining interengagement with said distal wall and hold said cleaning valve in said closed position.

7. The pipe of claim 1 in which said body and said shank have respective tapered proximal ends that interengage one another to define a mouthpiece of said pipe, said proximal end of said pipe body being disposed about said orifice, said mouthpiece enclosing a proximal end of said channel and said proximal end of said channel being exposed exteriorly of the pipe body through said orifice when said valve is in said first position.

8. The pipe of claim 4 in which a distal end of said shank includes a shoulder that interengages an interior surface of said distal wall of said pipe body to retain said valve within said bore of said body.

9. The pipe of claim 6 in which said actuator includes a disk for peripherally grasping to selectively rotate said cleaning valve from said second position to said first position wherein said magnetic components interengage one another and to selectively disengage said magnetic components from one another and rotate said valve from said first position to said second position.

10. The pipe of claim 9 in which a distal end of said shank includes a shoulder that interengages an interior surface of said distal wall of said pipe body to retain said valve within said bore of said body; there being longitudinal play between said shoulder of said shank and the inside surface of said distal wall, as well as between the inner surface of said disk and the outer surface of said distal wall to permit said disk to pull apart from said distal wall and selectively disengage said magnetic components from one another wherein said actuator is permitted to be axially rotated to alternate said valve from said first position to said second position.

11. The pipe of claim 1 in which said combustion chamber includes a discharge outlet that communicates with said bore of said pipe body, said channel communicating with said discharge outlet when said valve is in said first position so that smoke produced when tobacco is burned in said combustion chamber migrates through said discharge outlet and into said channel, which transmits that smoke to said orifice.

12. The pipe of claim 1 in which said pipe body includes a relatively narrow stem portion that carries said orifice and a relatively wide stummel portion that carries said bowl portion.

13. The pipe of claim 12 in which said stem portion and said stummel portion are unitarily interconnected.

14. The pipe of claim 1 in which said cleaning valve is removably insertible into said bore through an opening formed in a distal end of said pipe body.

15. The pipe of claim 1 in which said cleaning valve further includes a mounting member for covering said distal end opening in said pipe body.

16. The pipe of claim 15 in which said mounting member and said pipe body include complementary magnetic components that are selectively interengaged to hold the mounting member against a distal end of said pipe body with said valve in said first position such that said channel remains in communication between said combustion chamber and said orifice.

17. The pipe of claim 16 in which said mounting member is selectively removed from said distal end of said pipe body by disengaging said complementary magnetic components to withdraw said cleaning valve from said pipe body and expose said longitudinal channel for cleaning.

* * * * *